US006096146A

United States Patent [19]

Poloni et al.

[11] Patent Number: 6,096,146

[45] Date of Patent: Aug. 1, 2000

[54] METHOD FOR HEAT TREATING ROLLED STOCK AND DEVICE TO ACHIEVE THE METHOD

[75] Inventors: Alfredo Poloni, Fogliano di Redipuglia; Matteo Bellina, Tavagnacco; Giuseppe Bordignon, Bicinicco; Massimo Lestani, Sequals, all of Italy

[73] Assignee: Danieli & C. Officine Meccanichi SpA, Buttrio, Italy

[21] Appl. No.: 09/090,383

[22] Filed: Jun. 4, 1998

[30] Foreign Application Priority Data

Jun. 5, 1997 [IT] Italy ..... UD97A0105

[51] Int. Cl.[7] ..... C21D 8/02; C21D 8/06; C21D 9/00

[52] U.S. Cl. ..... 148/601; 148/602; 148/654; 148/661; 266/115; 266/259

[58] Field of Search ..... 148/541, 546, 148/602, 601, 598, 654, 661; 266/115, 259

[56] References Cited

U.S. PATENT DOCUMENTS

| | | | |
|---|---|---|---|
| 2,756,169 | 7/1956 | Corson et al. . | |
| 3,735,966 | 5/1973 | Hoffmann . | |
| 4,146,411 | 3/1979 | Dewsnap et al. | 148/598 |
| 4,168,993 | 9/1979 | Wilson et al. | 148/598 |

FOREIGN PATENT DOCUMENTS

| | | | |
|---|---|---|---|
| 854647 | 9/1977 | Belgium . | |
| 312843 | 4/1989 | European Pat. Off. . | |
| 473561 | 3/1992 | European Pat. Off. . | |
| 787808 | 8/1997 | European Pat. Off. . | |
| 2231758 | 12/1974 | France . | |
| 2684691 | 6/1993 | France . | |
| 88615 | of 0000 | Germany . | |
| 405179346 | 7/1993 | Japan | 148/602 |

*Primary Examiner*—Deborah Yee
*Attorney, Agent, or Firm*—Antonelli, Terry, Stout & Kraus, LLP

[57] ABSTRACT

Method for heat treating rolled stock leaving a rolling train (12), wherein the rolled stock (13) undergoes a rapid cooling treatment in a rapid cooling assembly (11) located immediately downstream of the last rolling pass, the first cooling step being followed by a temperature-equalisation step in air and at least by a second cooling treatment before being discharged and collected, the temperature-equalisation step in air and the at least second cooling treatment being set so as not to modify the surface and inner crystalline structure of the rolled stock (13) which has formed at the outlet of the first cooling treatment, the at least second cooling treatment being followed by a short segment of temperature-equalisation in air and then directly by the collection of the rolled stock (13) into compact form, such as rolls coils bundles or packs, wherein the slow cooling of the rolled stock (13) collected in compact form leads to the transformation of the crystalline structure in the stable structures. Device for heat treating rolled stock achieving the method as described above.

14 Claims, 2 Drawing Sheets

METHOD FOR HEAT TREATING ROLLED STOCK AND DEVICE TO ACHIEVE THE METHOD

BACKGROUND OF THE INVENTION

This invention concerns a method for heat treating rolled stock, and the device to achieve the method.

To be more exact, the invention is applied to rolled products leaving the rolling step and before they are collected and/or wound into compact structures such as coils, rolls, bundles or packs.

The rolled stock to which the invention is applied may belong either to the class of materials which require a process of surface hardening followed by tempering, and also that class of materials wherein it is not desired to obtain surface structures which are typical of a hardening process and on which cooling is performed with speeds lower than the speed at which the original austenitic structure is transformed into a martensitic structure.

The state of the art covers the problems relating to cooling treatments carried out on rolled stock leaving the rolling train, which also have the function of guaranteeing that the product has optimum characteristics of quality and structure, both surface and internal.

In the state of the art we can identify two classes of materials which are of interest.

The first is rolled stock which, as it leaves the last rolling pass with an austenitic crystalline structure, is subjected to surface hardening and subsequent tempering, with the crystalline structure being transformed into a martensitic, or at most bainitic, surface structure in the surface and subsurface layers.

The second is rolled stock which, as it leaves the last rolling pass, is cooled with different criteria but in any case with the purpose of not obtaining structures which are typical of hardening and for which the transformation of the austenitic structure in the relative stable structure is begun and completed after the stock has been discharged from the rolling line, typically in a cooling bed or plane.

For the first class of products, it is well-known that a rapid cooling may be applied to the product when it leaves the last rolling pass so as to exceed a determined cooling speed, or critical speed, above which crystalline micro-structures are formed, characterised by great hardness and resistance.

This rapid cooling, which hardens the surface of the product, obtains a surface area wherein there are very fine martensitic structures which are typical of the hardening process. The martensitic structures are obtained by suppressing the transformation of austenite because of the rapidity of the fall in temperature.

At the same time, bainitic structures are obtained below the surface of the rolled stock, while in the core of the product, where the removal of heat is slower and the temperature is maintained higher, pearlitic structures are obtained which are less resistant but are extremely tough.

The cooling may be regulated so as to obtain different depths of treatment and thus, by balancing the mechanical properties of the different structures which are created at the different depths of the product, to achieve the best balance of resistance and toughness of the finished product. With these opportunities of regulating the treatment, in terms of at least duration and intensity of cooling, it is possible to process materials with different diameters and different chemical compositions in order to obtain the same mechanical and quality requirements on different types of products.

By using the heat treatment as described above, it is possible to obtain the minimum mechanical characteristics as established by different national legislations without requiring the use of binding elements which would inevitably increase the cost of the product. Moreover, given their limited carbon content, the welding characteristics of the rolled stock are maintained.

Therefore, the compromise between mechanical resistance and toughness of the product, so as to satisfy the required standards of quality, is substantially based on the parameters of duration and intensity of cooling applied.

These parameters not only define the specific penetration of the hardening process, they also determine the level of heat which is established on the rolled product when the heat of the core spreads towards the surface areas and equalises the temperature over the whole section of the rolled stock.

It is extremely important to know and define the level of heat since it measures the efficiency of the tempering of the martensitic structures obtained in the surface areas of the product. The tempering takes place during at least part of the temperature-equalisation step which follows the rapid cooling.

At the end of the temperature-equalisation step, in the subsequent air cooling step, for example carried out in the cooling bed, wherein the temperature at all points of the product begins to fall, the tempering process continues; at this stage of the process, the hardness of the surface areas is redimensioned, and at the same time there is a considerable increase in the toughness.

In those cases when the cooling is carried out in the cooling bed, the speed at which the temperature falls is in any case sufficiently high to limit the negative effects of an excessive tempering on the mechanical characteristics of the surface of the product. If on the contrary the product is immediately arranged into compact structures, for example, wound into rolls or coils, the reduction of surface exposed to heat exchange through convection or radiance causes a considerable slow-down in the cooling treatment with a consequent increase in times.

This increase in the cooling times causes a greater efficiency and influence of the hardening process and therefore a deterioration in the mechanical characteristics of the material which is often excessive and unacceptable.

For this reason, in the state of the art the rolled product is always subjected to a step of natural, air cooling, and it is only when this cooling is completed in times compatible with balancing the consequences of the tempering process, and the crystalline structure is stabilised, that the product is collected and discharged.

This involves an obvious and enormous increase in the space needed on the line.

For the second class of materials, which consists of products which are not subject to a hardening process, it is well-known in the state of the art to cool the product downstream of the last rolling pass to different degrees but in any case in a manner such as to exclude the formation of those structures which are typically produced by hardening, such as martensite or bainite.

In these cases, the cooling speed is therefore less than the speed which leads to martensitic transformation and the heat is removed from the rolled stock in such a manner so as not to create palpable differences between the surface area and the core of the product.

The transformation of the austenite in the stable crystalline structures is therefore generally achieved with mechanisms of nucleation and growth which typically need relatively long times.

The phases in the finished product, along its whole section, will be ferrite and pearlite in percentages which will depend on the chemical composition of the raw material. In some cases, for steel alloys, there may also be bainite.

In this case, it is above all a uniformity of structure which is desired, while the level of the mechanical properties required may differ considerably due to the different types of steel treated.

According to the properties required the cooling process may be carried out in different ways; however, in all cases, as it is transported on the line, the rolled stock is given the time necessary for it to cool naturally in air so that the phase transformations of the austenite can take place in the stable structures.

On the contrary, in the event that the product is collected in compact structures, such as rolls and coils, immediately after the rolling process, the reduction of the surface exposed to heat convection and radiance causes a considerable slowdown in the cooling process.

This modifies in a substantial manner the heat cycle of the rolled stock and leads to modifications of the micro-structure which inevitably affect the final properties thereof.

To be more exact, there may be modifications to the following: the relative quantities of the phases present, the micro-structure thereof and the size of the crystalline grains. These modifications can be such as to render the technological qualities of the rolled stock unacceptable.

Therefore, for both classes of materials mentioned, both those products which have to be subjected to hardening and tempering, and also those where it is not desired to obtain structures typical of hardening, there is a common technical problem which hinders the immediate collection of the rolled stock into compact structures and, on the contrary, in order to obtain the required characteristics of quality and technology, requires a long section of natural air cooling to be performed.

The present applicants have designed, tested and embodied this invention to overcome the shortcomings of the state of the art, and to obtain further advantages.

SUMMARY OF THE INVENTION

The purpose of the invention is to achieve a heat treatment for products leaving the rolling train which will enable the product to be collected and arranged into compact structures such as rolls, coils, bundles or packs.

The heat treatment according to the invention avoids the negative consequences caused by having to excessively maintain the temperature of the material/product; it overcomes the disadvantages which derive from the reduction of the heat exchange through convection and radiance and the consequent cooling once the material is arranged into a compact structure, and the consequent increase in the cooling times once the product is wound into the compact structure.

The invention can be applied, for example, to long products in wire or in bars of whatsoever section and with a wide range of diameters, or also to flat products such as sheet or strip.

The invention is applied, with a substantially identical concept, both to a first class of materials which are subjected to a treatment of surface hardening followed by tempering, and also to a second class which is not subjected to this treatment and in which it is not desired to obtain the effects of surface hardening.

The invention provides to apply a first rapid cooling step to the rolled stock as it leaves the last rolling pass in order to create a surface characterised by a homogenous crystalline structure, whether it be martensitic in the event that the rolled stock is surface hardened, or austenitic in the event that no surface hardening is performed.

The invention then provides for a temperature-equalisation step in air followed by at least one, advantageously two or four, intermediate cooling stage, wherein each intermediate cooling stage is set in such a way as not to modify the crystalline surface structure which has formed in the first rapid cooling step, which remains mostly unchanged.

The intermediate cooling stages are then followed by a brief segment of temperature-equalisation and then directly by the winding of the rolled stock into rolls or coils, or by the collection into bundles or packs.

The transformation in the crystalline stable structures is completed with the rolled stock collected into compact form.

According to the invention, in the case of materials of the first class, the product leaving the rolling train is subjected to the conventional steps of rapid cooling and at least partial hardening, which causes the formation of martensitic structures of high resistance on its surface, and also to the temperature-equalisation step on the various depths of the section.

According to the invention, the tempering process of the material/product which follows the rapid cooling step is interrupted in its first stages by means of cooling in at least one stage, preferably from two to four cooling stages.

As a consequence of the interruption in the tempering process at the end of the temperature-equalisation step which follows the rapid cooling treatment, the high resistance martensitic structures present on the surface of the product are only minimally affected and modified by the propagation of the heat from the core to the periphery of the rolled stock.

According to the invention, the cooling stages following the rapid cooling step are regulated in duration and intensity of cooling so that the crystalline structures which have formed in the material are not modified.

Therefore, the temperature of the inner part of the rolled stock which has not been hardened is in any case maintained above the level at which the martensite forms, so as not to cause increases in thickness of the outer, hardened zone, which would cause a reduction in ratio between the ultimate tensile strength and the yield point of the material, that is to say, a reduction of the ductility of the material.

Moreover, the cooling stages are separated from each other by temperature-equalisation zones which allow the material to stay well above the zone where the martensite forms in the inner part.

The subsequent final winding of the rolled stock into compact coils is such as to create the proper conditions for a slow cooling which, coupled with defined and specific temperature values, make it possible to complete the tempering of the hardened outer crown, previously interrupted, in an optimum manner.

The method described above can be applied to killed or semi-killed steels containing manganese, for example with a percentage of between 0.25 and 1.5%, and a low carbon content. Moreover, according to a variant which can be adopted in the production of special steels, it is possible to use microbinding components such as vanadium and/or niobium and/or titanium, in order to increase resistance and the surface hardness of the steel.

The low carbon content of the steel ensures that the product thus obtained is completely weldable.

In the case of materials of the second class, which are usually subjected to controlled cooling in order not to obtain structures typical of hardening, the rolled stock leaving the rolling mill is cooled at a speed above critical speed, but in such a way that the temperature does not go below the level at which martensite forms.

During the first cooling stage, a considerable quantity of heat is therefore removed, but without reaching the point of martensitic transformation.

The quantity of heat removed during this stage may be regulated by acting on the intensity and duration of the cooling according to the type of steel being treated and the size of section of the rolled stock.

After this rapid cooling there is a temperature-equalisation step and, subsequently, at least one and preferably from two to four subsequent cooling stages.

These cooling stages are characterised in that the surface temperature of the rolled stock does not go below the level of bainite formation characteristic of the specific steel being treated.

In this way, the proper conditions are created for the nucleation and growth, in the finished product, of a crystalline structure consisting uniformly of pearlite and ferrite, the formation of which will be completed during and after the product has been wound into compact form.

With this method of cooling, the heat exchange of the rolled stock is optimised and the cooling stages following the first one can be managed so as to achieve the optimum winding temperature.

This temperature level constitutes the departure point of the final processing step, which consists of the slow cooling of the spirals of the wound coil.

During this step the temperature must be such as to guarantee that the phenomena indicative of a deterioration in the micro-structure, such as for example, the excessive growth of the grain, are not active.

The second class of materials may comprise low, medium and high carbon content steels, alloyed steels and stainless steels.

By using these heat treatment processes, the rolled product may be sent directly to the step wherein it is wound or coiled into compact structures, without needing a prolonged cooling; this makes it possible to obtain a huge saving in the space occupied in the line and a reduction in the space needed to store the product.

BRIEF DESCRIPTION OF THE DRAWINGS

The attached Figures are given as a non-restrictive example, and show a preferential embodiment of the invention as follows.

DETAILED DESCRIPTION OF THE INVENTION

Figure 1:
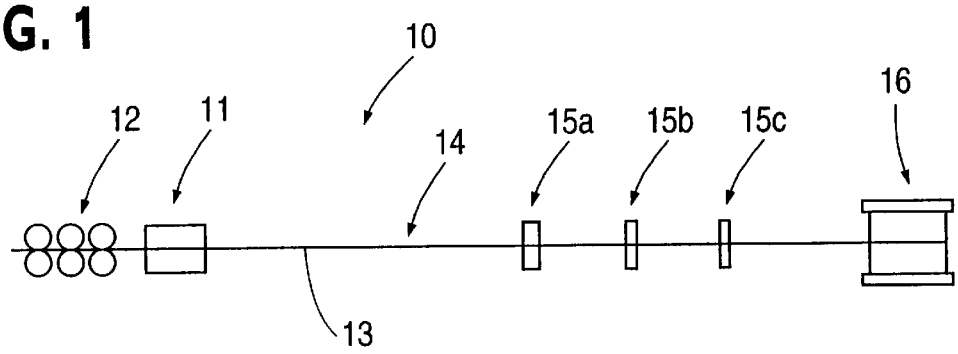
FIG. 1 shows in diagram form the end part of a rolling line using the invention.

The rolling line 10, shown in its end portion in FIG. 1, comprises a rapid cooling assembly 11 arranged at the outlet of the rolling train 12 from which the rolled stock 13 leaves in its final form.

In the case of steels with a low carbon content, or special steels containing micro-binding components such as vanadium and/or niobium and/or titanium, the rapid cooling assembly 11 performs a hardening process on the rolled stock 13 so as to determine the formation on the outer surface of a very fine martensitic structure, while in the layer immediately below a bainitic structure forms and in the core a pearlitic structure forms which is less resistant but extremely tough.

The cooling treatment and hardening is carried out in such a way as to remove an extremely high quantity of heat (see FIG. 2 which shows how in the rapid cooling assembly 11 the temperature of the surface of the rolled stock 13 passes from values of around 1000° C. to about 200° C.) so as to achieve the metallurgical transformation as described above.

The rapid cooling assembly 11 is followed by a segment 14 of at least partial temperature-equalisation in air, wherein the rolled stock 13 begins to temper due to the progressive propagation of heat from the core to the surface.

According to the invention, at a defined distance from the rapid cooling assembly 11, there is a first cooling stage 15*a*. The first cooling stage 15*a* stops the tempering of the rolled stock 13 so that the martensitic structures present on the surface are not modified.

Figure 2:
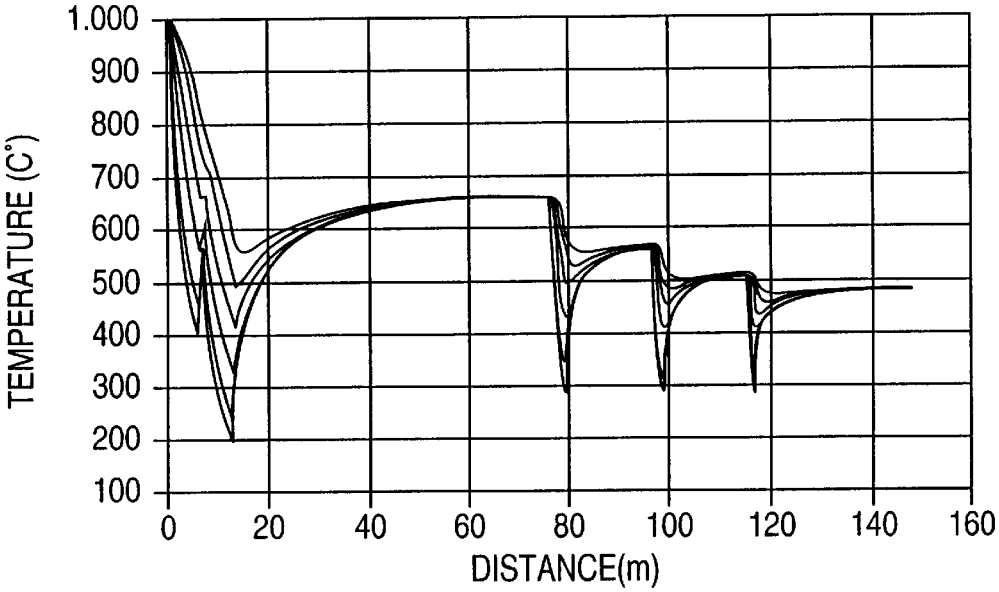
FIG. 2 shows a temperature/distance graph which shows, with reference to FIG. 1, the temperatures of the surface of the product subjected to the heat treatment according to the invention and belonging to the first class of materials subjected to hardening and tempering.

As can be seen in FIG. 2, the first cooling stage 15*a* causes a reduction in the temperature from about 650° C. to a value in the region of 300° C.

After a brief segment of temperature-equalisation in air, which causes an increase in the surface temperature deriving from the progressive propagation of heat from the core of the rolled stock 13, there is a second cooling stage 15*b* on the line 10 by means of which the surface temperature is again returned to a value in the order of 300° C.

The second cooling stage 15*b* is also followed by a brief segment of temperature-equalisation in air and then by a third cooling stage 15*c*, by means of which the surface temperature of the rolled stock 13 is again returned to values which, in this case, are around 300° C.

This succession of cooling stages 15*a*, 15*b*, 15*c* serves to interrupt the progression of the tempering process, preventing the heat propagating from the core of the rolled stock 13 from modifying the martensitic structures which have formed on the surface of the rolled stock 13.

The plurality of cooling stages and the relatively low temperature reduction which each of these brings in any case prevent the depth of the martensitic surface layer from increasing, leaving the crystalline structure substantially unchanged and as it was when it formed at the outlet of the rapid cooling treatment and hardening performed by the assembly 11.

The cooling stages 15*a*, 15*b*, 15*c* are set for duration and intensity of cooling, according to the size of section of the product and its chemical composition, so that the surface temperature does not fall significantly, in this case, below 300° C., so as not to modify the crystalline structure, as explained above, and to avoid the formation of martensite also in the inner part of the rolled stock 13, which would compromise the ductility of the product.

Moreover, the cooling stages are set so that the surface temperature of the rolled stock 13 assumes a value, at the moment when it is wound onto the relative winding assembly 16, not less than a pre-set value, in this case between about 420° C. and 570° C.

This temperature value serves to ensure that even in conditions of limited heat exchange due to convection and radiance, as derive from the compact winding of the rolled stock 13 onto the winding assembly 16, the slow-down in the cooling times does not cause modifications and negative consequences to the overall crystalline structure, particularly on the martensitic surface structure of the rolled stock 13.

The succession of cooling stages 15*a,* 15*b* and 15*c* between the rapid cooling step and the winding of the rolled stock 13 avoids the need for a cooling step in a cooling bed, which gives considerable advantages in terms of space to store the material, space taken up by the line and overall times required to obtain the final product.

In the case of steels with a low, medium or high carbon content, which do not require a surface hardening treatment, the rapid cooling assembly 11 is pre-set to take the surface of the rolled stock 13 to a value not less than the level at which martensite forms.

In this case (FIG. 3), the surface temperature of the rolled stock 13 is taken to a value of not less than 500° C., so that the substantially homogenous austenitic structure is not transformed.

The function of the segment 14 in air is to equalise the temperature of the core and the surface, while the first intermediate cooling stage 15*a,* like the subsequent stages 15*b* and 15*c,* are set and regulated, in terms of duration and intensity of cooling, in such a way that the surface temperature of the rolled stock 13 is not taken below the level at which bainite forms, or in any case it is not taken to the point which would begin the transformation of the austenitic structure of the rolled stock 13 entering the segment 14.

Figure 3:
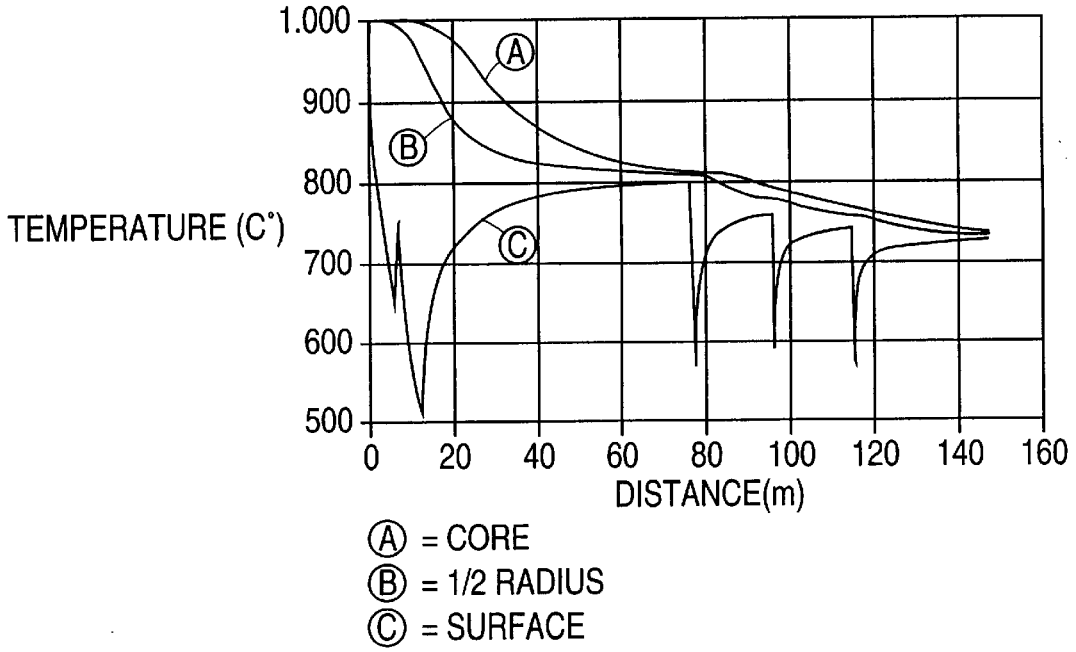
FIG. 3 shows a temperature/distance graph which shows, with reference to FIG. 1, the temperatures of the surface, at a point about half the radius and at the core of a product with a round section subjected to the heat treatment according to the invention and belonging to the second class of materials which are not subjected to surface hardening.

As can be seen from the graph in FIG. 3, in all the intermediate cooling stages 15*a,* 15*b,* 15*c,* which are separated from each other by short temperature-equalisation segments, the temperature of the rolled stock 13 is lowered to a value of around 600° C., at which temperature no transformation of the crystalline structure is started.

The short cooling cycles, followed by equally short equalisation segments, therefore serve to progressively lower the temperature of the rolled stock, causing sudden changes of temperature of a limited value, wherein the crystalline structure of the rolled stock 13 is not modified in a substantial manner.

When it leaves the last cooling stage 15*c,* the surface temperature of the rolled stock 13 is lowered to a value which will obtain a temperature of between 650° C. and 750° C. when the rolled stock 13 is wound into compact form onto the winding assembly 16.

At the same time, cooling can be completed, and consequently the austenite transformed in the stable structures, with the rolled stock 13 wound into compact structures, for example on the winding assembly 16, wherein there are considerable differences in behaviour between the inner and outer part and also between the top and bottom of the coil or roll.

Figure 4:
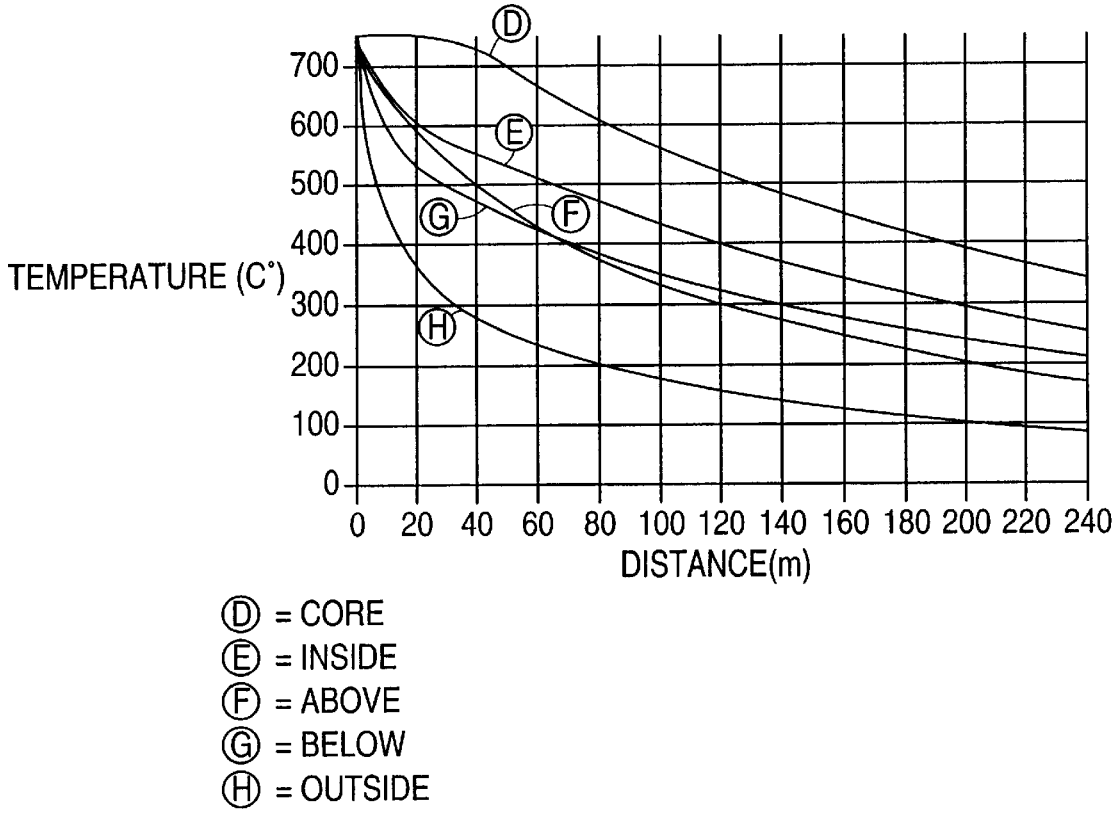
FIG. 4 shows a temperature/time graph which shows the temperatures at different points of a coil of a product which has not been hardened, wound at 750° C.

FIG. 4 shows an example of the graph which illustrates the cooling curves of a coiled round piece with a diameter of 10 mm and a weight of 2400 Kg at five zones of the round piece, that is to say, inside, below, outside, above and the core.

The temperature is shown on the y-coordinate and the time is shown on the x-coordinate.

What is claimed is:

1. Method for heat treating rolled stock leaving a rolling train (12), wherein the rolled stock (13) undergoes a rapid cooling treatment in a rapid cooling assembly (11) located immediately downstream of the last rolling pass, the first cooling step being followed by a temperature-equalisation step in air and at least by a second cooling treatment before being discharged and collected, the method being characterised in that the temperature-equalisation step in air and the at least second cooling treatment are set so as not to modify the surface crystalline structure or the inner crystalline structure of the rolled stock (13) which has formed at the outlet of the first cooling treatment, the at least second cooling treatment being followed by a short segment of temperature-equalisation in air and then directly by the collection of the rolled stock (13) into compact form, such as rolls, coils, bundles or packs, wherein the slow cooling of the rolled stock (13) collected in compact form leads to the transformation of the crystalline structure in the stable structures.

2. Method as in claim 1, wherein the segment between the rapid cooling step and collection into compact form, the rolled stock (13) is subjected to from two to four intermediate cooling stages.

3. Method for heat treating rolled steel products with low carbon content, killed or semi-killed, with a manganese content of between 0.25 and 1.5%, as in claims 1 or 2, wherein the first rapid cooling treatment is set so as to create a martensitic surface structure, a bainitic sub-surface structure and a pearlitic inner structure, the first rapid cooling treatment being followed by a temperature-equalisation step in air and a surface tempering, the surface tempering being stopped in at least an intermediate cooling stage (15*a*) before the deterioration of the martensitic surface structure, the at least one cooling stage (15*a*) being set in such a way as not to modify the inner crystalline surface and at least so as to prevent the formation of martensitic structure in the inner part of the rolled stock (13), the at least one cooling stage (15*a*) being followed by a brief segment of temperature-equalisation in air and then directly by the collection of the rolled stock (13) into compact form.

4. Method as in claim 3, wherein the tempering of the surface of the rolled stock (13) with the martensitic structure is completed with the rolled stock (13) already arranged in compact form on the relative winding assembly (16).

5. Method as in claim 3, which provides a plurality of intermediate cooling stages (15*a,* 15*b,* 15*c*), wherein in each of the intermediate cooling stages the surface temperature of the rolled stock (13) is lowered to a value not less than 300° C. in order to maintain the crystalline structure of the bainitic sub-surface and the pearlitic inner structure.

6. Method as in claim 5, wherein the last cooling stage (15*c*) upstream from the collection into compact form causes the surface temperature of the rolled stock (13) to be lowered in order to obtain a surface temperature of the rolled stock (13) of between 420° C. and 570° C. at the moment when it is wound into compact form on the winding assembly (16).

7. Method as in claim 3, which is applied to steels enriched with micro-binders such as vanadium and/or niobium and/or titanium.

8. Method for heat treating rolled products of steel with a medium or high carbon content, steel alloy or stainless steel as in claim 1, wherein the first rapid cooling treatment is set to cool the rolled stock at a speed above critical hardening speed and to take the surface temperature of the rolled stock (13) to a value not less than the level at which the austenitic structure is transformed into martensite, the first rapid cooling treatment being followed by a step of temperature-equalisation in air followed by at least one stage of intermediate cooling (15*a*), the at least one stage of cooling (15*a*) being set in such a way as not to take the surface temperature below the level at which bainite is formed, the at least one stage of cooling (15*a*) being followed by a brief segment of temperature-equalisation in air and then directly by the collection of the rolled stock (13) into compact form.

9. Method as in claim 8, wherein the transformation of the austenite in the stable structures is completed with the rolled stock (13) collected in compact form.

10. Method as in claims 8, which provides a plurality of intermediate cooling stages (15*a,* 15*b,* 15*c*), wherein in each of the intermediate cooling stages the surface temperature of the rolled stock (13) is lowered to a value not less than the upper limit, characteristic of the specific steel treated, at which austenite is transformed into bainite.

11. Method as in claim 10, wherein the last cooling stage (15*c*) upstream of the collection into compact form causes the surface temperature of the rolled stock (13) to be lowered in order to obtain a surface temperature of the rolled stock (13) of between 650° C. and 750° C. at the moment when it is wound into compact form on the winding assembly (16).

12. Device for heating rolled stock leaving a rolling train (12), the device being characterised in that it comprises a rapid cooling assembly (11) located immediately downstream of the last rolling pass and creating in the rolled stock a defined crystalline surface structure, the rapid cooling assembly (11) being followed by a segment (14) of temperature-equalisation in air and by between one and four cooling stages (15*a,* 15*b,* 15*c*), each of the cooling stages (15*a,* 15*b,* 15*c*) being set in such a way as not to modify the crystalline surface structure which has formed at the outlet of the rapid cooling assembly (11) which remains mostly unchanged, the cooling stages (15*a,* 15*b,* 15*c*) being followed by a brief segment of temperature-equalisation in air and by the direct collection of the rolled stock (13) into compact form (16).

13. Method as in claim 1, wherein the rolled stock (13) has a low carbon content, and wherein the rapid cooling treatment is set so as to create a martensitic surface structure, a bainitic sub-surface structure and a pearlitic inner structure, the first temperature-equalisation step in air being stopped in at least a first intermediate cooling stage (15*a*) before the deterioration of the martensitic surface structure, the first intermediate cooling stage (15*a*) being set in such a way as not to modify the inner crystalline surface and at least so as to prevent the formation of martensitic structure in the inner part of the rolled stock (13), and the first intermediate cooling stage (15*a*) being followed by the second temperature-equalisation step in air.

14. Method as in claim 1, wherein the rolled stock (13) is of killed or semi-killed and has a manganese content of between 0.25 and 1.5%.

* * * * *